US006307456B1

(12) United States Patent
Caggiano et al.

(10) Patent No.: US 6,307,456 B1
(45) Date of Patent: Oct. 23, 2001

(54) LIGHT INDUSTRIAL CIRCUIT BREAKER TERMINAL COVER

(75) Inventors: Robert J. Caggiano, Wolcott; Michael R. Wood, Southington; Richard E. Saunders, Granby; David D. MacDonald, Unionville, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/459,173

(22) Filed: Dec. 10, 1999

(51) Int. Cl.[7] ..... H01H 13/04; H01H 9/02

(52) U.S. Cl. ..... 335/202; 174/138 F; 200/304; 200/305

(58) Field of Search ..... 335/202; 174/66, 174/138 F; 200/304, 305

(56) References Cited

U.S. PATENT DOCUMENTS

| | | | | |
|---|---|---|---|---|
| 5,049,846 | | 9/1991 | Morgan et al. | 335/202 |
| 5,084,689 | | 1/1992 | Morgan et al. | 335/202 |
| 5,150,091 | | 9/1992 | Hart et al. | 335/202 |
| 5,742,008 | * | 4/1998 | Dalrymple | 174/99 R |
| 6,012,683 | * | 1/2000 | Howell | 248/49 |
| 6,120,425 | * | 9/2000 | Endelman | 482/142 |

* cited by examiner

*Primary Examiner*—Ramon M. Barrera
(74) *Attorney, Agent, or Firm*—Cantor Colburn LLP; Carl B. Horton

(57) ABSTRACT

An electrically-insulative terminal cover is arranged on the line end of a light industrial-rated circuit breaker to allow a close-fit arrangement between a plurality of such circuit breakers within a common enclosure. The terminal cover is in the form of a top piece and a perpendicular side piece. The top piece comprises a pair of notches for receiving a pair of electrical conductors connecting with a corresponding pair of circuit breaker electrical terminals. The side piece includes a pair of elongated notches adapted for receiving sides of a pair of adjacent circuit breakers. A center side piece between the elongated notches can be press-fit within a combined slot defined by slots in sides of a pair of abutting side walls of adjacent circuit breakers. The top piece provides electric isolation to a top of the electrical terminals while the side piece provides electric isolation to a front of the electrical terminals.

21 Claims, 2 Drawing Sheets

LIGHT INDUSTRIAL CIRCUIT BREAKER TERMINAL COVER

BACKGROUND OF THE INVENTION

This invention relates to a terminal cover for a circuit breaker for preventing electrical crossover between adjoining circuit breaker terminals. In particular, this invention relates to a terminal cover for a light industrial rated circuit breaker that can be installed without the use of fasteners and which does not interfere with adjacent mounting of multiple breakers.

Industrial-rated circuit breakers in excess of 600 volt rating, such as described within U.S. Pat. No. 5,150,091 entitled "Bus Cover and Lug Cover for a Molded Case Circuit Breaker," are often required to become positioned next to similar circuit breakers within a common enclosure. To prevent electrical crossover between adjoining circuit breaker terminals upon the occurrence of a short circuit over-current condition within adjoining circuit breakers, the circuit breakers must be separated by a sufficient distance for electrical over-surface clearance.

U.S. Pat. Nos. 5,084,689 and 5,049,846, both entitled "Compact Molded Case Circuit Breaker with Increased Ampere Rating," describe the use of lug cover extensions to the line end of the circuit breakers to protect the line lugs from inter-phasal faults.

The aforementioned U.S. patents describe the use of screws and the like to fixedly attach the separate lug covers to the circuit breaker enclosures at an added expense in materials, time, and labor.

So-called "light industrial-rated circuit breakers," up to 400 volt rating, are also used within common enclosures and are separated for over-surface clearance. Low costs are achieved by utilizing single pole circuit breakers attached together with a common handle tie for simultaneous ON-OFF operation. Because of the lower costs associated with such light industrial-rated circuit breakers, the added expenses of a lug cover was heretofore unwarranted. The space separation requirement limits the number of circuit breakers used within the enclosure with a resultant limitation in

SUMMARY OF THE INVENTION

Thus, there is a need for a lug or terminal cover to be used with light industrial-rated circuit breakers at a minimum increase in cost to allow several such circuit breakers to be used in adjacent relation within a common enclosure with minimal inter-circuit breaker spacial separation.

In an exemplary embodiment of the invention, an electrically-insulative terminal cover is arranged on the line end of a light industrial-rated circuit breaker to allow a close-fit arrangement between a plurality of such circuit breakers within a common enclosure. The terminal cover is preferably in the form of an integrally formed right-angled piece having a top piece and a perpendicular side piece. The top piece comprises a pair of notches for receiving a pair of electrical conductors connecting with a corresponding pair of circuit breaker electrical terminals. The side piece includes a pair of elongated notches adapted for receiving sides of a pair of adjacent circuit breakers. A center side piece between the elongated notches can be press-fit within a combined slot defined by slots in sides of a pair of abutting side walls of adjacent circuit breakers. The top piece provides electric isolation to a top of the electrical terminals while the side piece provides electric isolation to a front of the electrical terminals.

DETAILED DESCRIPTION OF THE INVENTION

Figure 1:
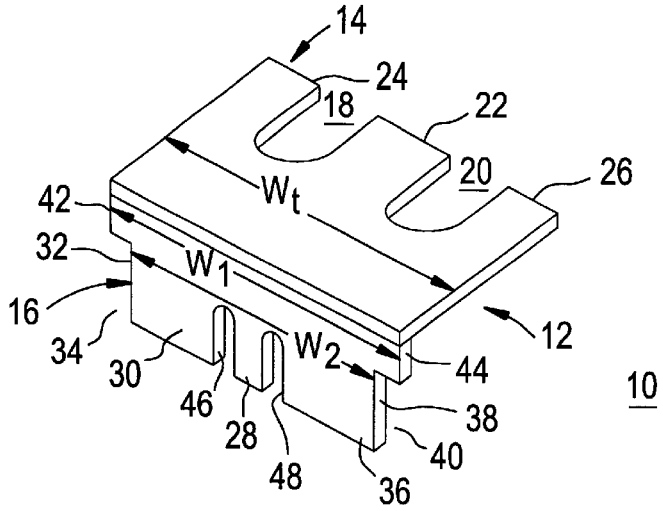
FIG. 1 is a top perspective view of a circuit breaker terminal cover in accordance with the invention.

The lug or terminal cover 10 is shown in FIG. 1 to comprise a right angle piece 12 defining a top piece 14 and a side piece 16 perpendicularly extending down therefrom. The piece 12 comprises an electrically insulative material, and is preferably integrally molded in plastic to form a one piece cover. A first notch 18 and a second notch 20 are formed within the top piece 14 on opposite sides of the center top piece 22 and with first and second end top pieces 24, 26 at the ends of the top piece 14 thereof. The open-ended notches 18 and 20 may extend from an outside edge of the top piece 14 to a rounded end within the top piece 14 as shown. The notches 18 and 20 are preferably parallel and of equivalent size, and are adapted to at least encompass the diameter of one line conductor extending from a circuit breaker.

A center side piece 28 is formed in the side piece 16 having a first elongated notch 46 on one side and a second elongated notch 48 on the opposite side with first and second end side pieces 30, 36 formed on the ends of the side piece 16. The elongated notches 46 and 48 may be open-ended and rounded as described above with respect to notches 18 and 20. The side piece 16 further comprises a first side 32 on first end side piece 30 and a second side 38 on second end side piece 36 which are indented from sides 42 and 44 of side piece 16. Preferably the width $w_l$, of the side piece 16 is equivalent to the width $w_t$, of the top piece 14 where the side piece 16 is adjacent the top piece 14. Where the side piece 16 is indented, the width $w_2$ is less than the width $w_1$. The resultant indents 34 and 40 preferably correspond in size to a thickness of an exterior wall of a circuit breaker for providing a snug fit with a circuit breaker as will be described.

Figure 2:
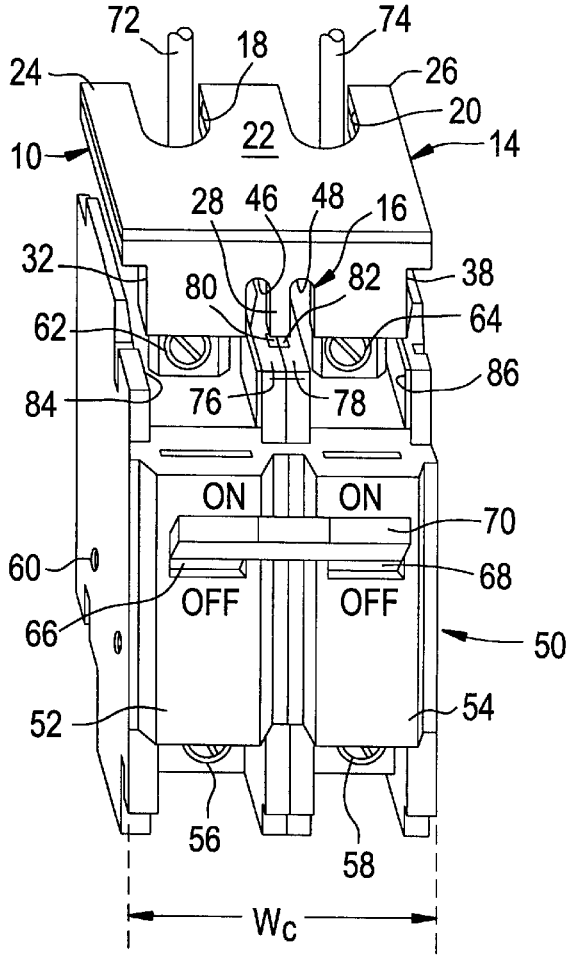
FIG. 2 is a front perspective view of the terminal cover of FIG. 1 in isometric projection with a light industrial-rated circuit breaker prior to attachment therewith.

The terminal cover 10 is shown in FIG. 2 prior to attaching to the line end of a two pole circuit breaker 50 consisting of a pair of single pole circuit breakers 52, 54 joined by rivets as indicated at 60. The load terminals 56, 58 are located at the bottom of the circuit breaker 50 with the line terminals 62, 64 at the top of the circuit breaker 50 to indicate the positioning of the terminal cover 10 over the line terminals 62, 64. The single pole circuit breakers include a pair of operating handles 66, 68 interconnected for common response by means of the handle tie 70 and are shown in the ON condition and a pair of line conductors 72, 74 are connected with the line terminals 62, 64. The line conductors 72, 74 extend through the notches 18, 20 formed in the top piece 14 with the center top piece 22 intermediate the line conductors 72, 74 and the end top pieces 24, 26 capturing the line conductors 72, 74 within the notches 18, 20, respectively.

When terminal cover 10 is attached to breakers 52, 54, center side piece 28, intermediate the elongated notches 46, 48, is captured within the combined slots 80, 82 formed by the slotted or grooved sides 76, 78 of the single pole circuit breakers 52, 54. That is, the slot 80 on side 76 combines with slot 82 on side 78 to form a single slot in which center side piece 28 is preferably snugly captured therewithin to retain the terminal cover 10 on the circuit breaker 50. Likewise, each notch 46, 48 is adapted to accept a portion of sides 76 and 78 therewithin. Simultaneously, the sides 32 and 38 are preferably captured within interior sides 84 and 86 of single pole circuit breakers 52 and 54, respectively.

Figure 3:
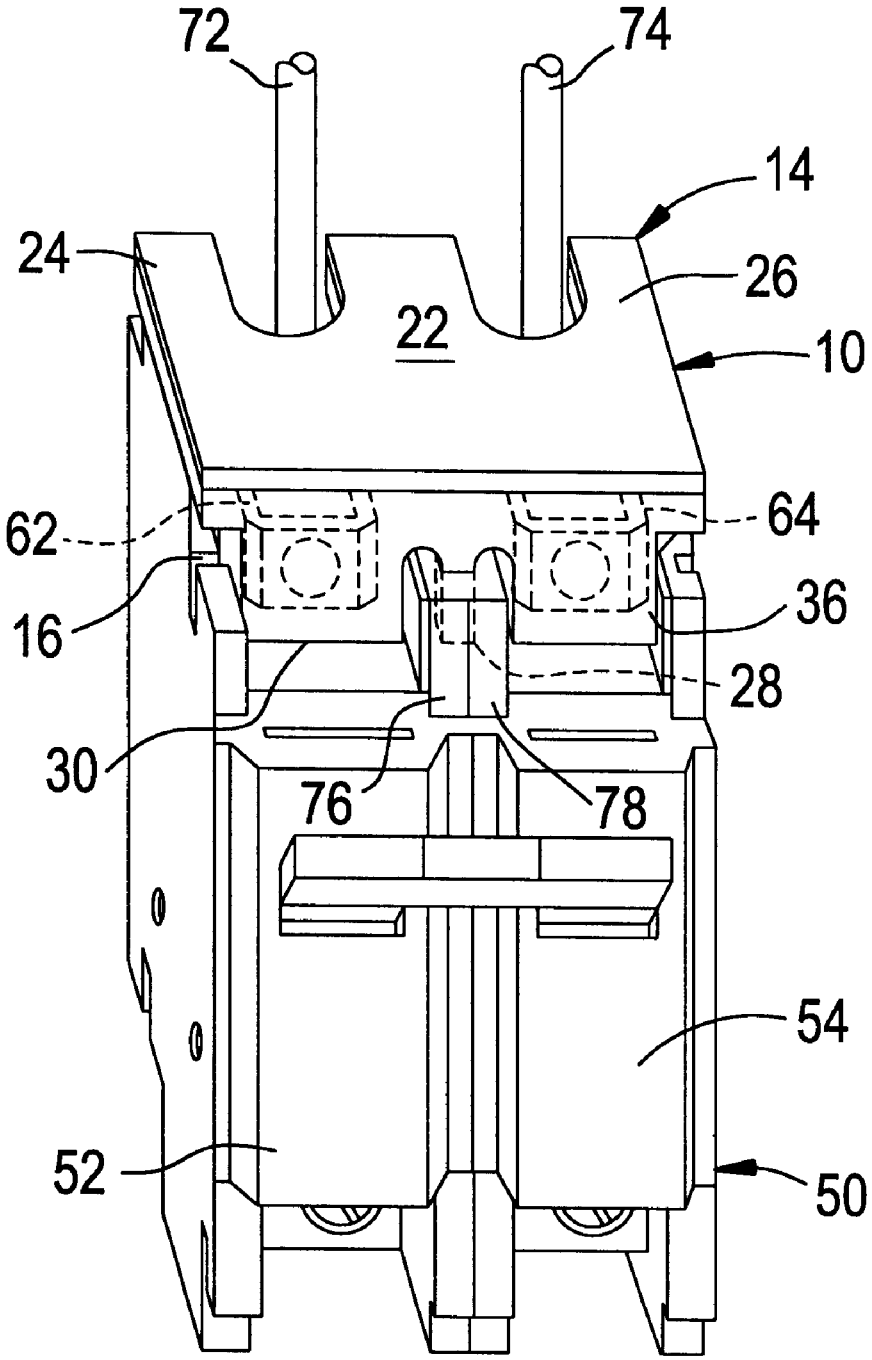
FIG. 3 is a front perspective view of the terminal cover attached to the circuit breaker of FIG. 2.

The terminal cover 10 is shown in FIG. 3 attached to the two pole circuit breaker 50 with the center side piece 28 of the side piece 16 captured within the slotted sides 76, 78 of the single pole circuit breakers 52, 54. The line terminals 62, 64 are shielded in the front by means of the end side pieces 30, 36 and are shielded at the top by means of the end top pieces 24, 26 and the center top piece 22 intermediate the line conductors 72, 74. Thus, the cover 10 may be simply attached to the breaker 50 using a press fit, eliminating the need for fasteners. Of course, a snap fit is also within the scope of this invention. The slotted or notched pieces 14 and 16 allow for easy installation/removal of the cover 10 without removing any wiring. When a pair of such "shielded" two pole circuit breakers 50 are arranged side-by-side within a common enclosure, the terminal covers on both of the shielded circuit breakers contribute to added protection against any arc occurrence within either of the shielded circuit breakers upon the occurrence of a short circuit condition within either of the adjacent circuit breakers. Furthermore, the width $w_t$ of the terminal cover 10 is preferably equivalent to the width $w_c$, of the circuit breaker 50. With the terminal cover 10 thus designed within the envelope of the circuit breaker 50, adjacent mounting of multiple breakers is enabled.

A simple terminal lug cover has been shown for attachment to the line end of a two pole circuit breaker by insertion within a combined slot formed within the slotted ends of the component single pole circuit breakers without requiring any additional fasteners.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A terminal cover for a pair of circuit breakers having line terminals, said terminal cover comprising:

a substantially planar top piece lying within a first plane, the top piece having a free end and an opposing attached end;

a substantially planar side piece lying within a second plane, the side piece having a free end and an opposing attached end, wherein the attached end of the top piece abuts with the attached end of the side piece and the first plane and the second plane intersect at a nonzero angle;

a first notch and a second notch formed within said free end of said top piece, said first and second notches adapted for receiving a pair of electrical conductors connecting with a corresponding pair of circuit breaker electrical terminals;

a enter top piece within said free end of said top piece and intermediate said notches;

a pair of elongated notches formed within said free end of said side piece, said elongated notches adapted for receiving sides of a pair of adjacent circuit breakers; and a center side piece intermediate said elongated notches, said center side piece being adapted for reception in press-fit relation within a combined slot defined by slots in sides of a pair of adjacent circuit breakers;

wherein the first and second notches are dimensionally larger than the pair of elongated notches.

2. The terminal cover of claim 1 including a pair of end side pieces within said side piece.

3. The terminal cover of claim 2 wherein the top piece has a width and the side piece comprises a first width equivalent to the width of the top piece and a second width, defined by a combined width of the pair of end side pieces, the center side piece, and the pair of elongated notches, which is less than the first width.

4. The terminal cover of claim 1 wherein said cover is electrically insulative.

5. The terminal cover of claim 4 wherein said cover comprises plastic.

6. The terminal cover of claim 1 wherein the first and second notches are symmetrically located within the top piece and the pair of elongated notches are symmetrically located within the side piece.

7. The terminal cover of claim 6 wherein the first and second notches are parallel to each other and the pair of elongated notches are parallel to each other.

8. The terminal cover of claim 1 wherein each of the first and second notches and the pair of elongated notches are open ended on one end and rounded on an opposite end thereof.

9. A multi-pole circuit breaker having electrically-isolated line terminals comprising:

a first single pole circuit breaker having a first line terminal intermediate a pair of first side wall extensions for connecting with a first line conductor;

a second single pole circuit breaker having a second line terminal intermediate a pair of second side wall extensions for connecting with a second line conductor, said first and second circuit breakers being attached to form a multi-pole circuit breaker whereby one of said first side wall extensions abuts one of said second side wall extensions to form an intermediate slot;

a terminal cover having a top piece and a downwardly depending side piece;

a pair of notches formed within said top piece, said notches adapted for receiving the first and second line conductors;

a center top piece intermediate said notches, said center top piece providing electric isolation to a top of said first and second line terminals;

a pair of elongated notches formed within said side piece, said elongated notches adapted for receiving side wall extensions of a pair of adjacent circuit breakers; and a center side piece intermediate said pair of elongated notches, said center side piece being adapted for reception in press-fit relation within said intermediate slot.

10. The multi-pole circuit breaker of claim 9 further comprising:

a first operating handle extending from said first circuit breaker for turning said first circuit breaker between ON and OFF conditions;

a second operating handle extending from said second circuit breaker for turning said second circuit breaker between ON and OFF conditions; and a handle tie connecting between first and second operating handles for moving said first and second operating handles in unison.

11. The multi-pole circuit breaker of claim 9 wherein the first single pole circuit breaker and the second single pole circuit breaker each have one non-abutting side wall extension, and wherein the side piece of the terminal cover comprises a first end side piece adjacent a first elongated notch and a second end side piece adjacent a second elongated notch, the side piece of the terminal cover further comprising a first indent adjacent the first end side piece and a second indent adjacent the second end side piece, wherein each indent is equivalent in width to a thickness of one non-abutting side wall extension.

12. The multi-pole circuit breaker of claim 9 wherein the top piece and the side piece of the terminal cover are perpendicular to each other.

13. The multi-pole circuit breaker of claim 9 wherein the side piece of the terminal cover comprises a pair of end side pieces, said end side pieces providing electric isolation to a front of the first and second line terminals.

14. The multi-pole circuit breaker of claim 9 wherein the intermediate slot is formed by a combination of a first groove and a second groove, the first groove and second groove located in the abutting first and second side wall extensions, respectively.

15. A terminal cover for a pair of circuit breakers having line terminals, said terminal cover comprising:

a top piece, the top piece having a width;

a side piece depending angularly from the top piece, the side piece including a pair of end side pieces, the side piece comprising a first width equivalent to the width of the top piece;

a first notch and a second notch formed within said top piece, said first and second notches adapted for receiving a pair of electrical conductors connecting with a corresponding pair of circuit breaker electrical terminals;

a center top piece within said top piece and intermediate said notches;

a pair of elongated notches formed within said side piece, said elongated notches adapted for receiving sides of a pair of adjacent circuit breakers; and a center side piece intermediate said elongated notches, said center side piece being adapted for reception in press-fit relation within a combined slot defined by slots in sides of a pair of adjacent circuit breakers;

wherein the side piece comprises a second width defined by a combined width of the pair of end side pieces, the center side piece, and the pair of elongated notches, the second width of the side piece being less than the first width of side piece.

16. The terminal cover of claim 15 wherein said cover is electrically insulative.

17. The terminal cover of claim 15 wherein the first and second notches are symmetrically located within the top piece and the pair of elongated notches are symmetrically located within the side piece.

18. The terminal cover of claim 15 wherein first and second notches are parallel to each other and the pair of elongated notches are parallel to each other.

19. The terminal cover of claim 15 wherein each of the first and second notches and the pair of elongated notches are open ended on one end and rounded on an opposite end thereof.

20. The terminal cover of claim 15 wherein the top piece and the side piece are perpendicular.

21. A terminal cover for a pair of circuit breakers having line terminals, said terminal cover comprising:

a substantially planar top piece lying within a first plane, the top piece having a free end and an opposing attached end;

a substantially planar side piece lying within a second plane, the side piece having a free end and an opposing attached end, wherein the attached end of the top piece abuts with the attached end of the side piece and the top piece and the side piece are perpendicular;

a first notch and a second notch formed within said free end of said top piece, said first and second notches adapted for receiving a pair of electrical conductors connecting with a corresponding pair of circuit breaker electrical terminals;

a center top piece within said free end of said top piece and intermediate said notches;

a pair of elongated notches formed within said free end of said side piece, said elongated notches adapted for receiving sides of a pair of adjacent circuit breakers; and a center side piece intermediate said elongated notches, said center side piece being adapted for reception in press-fit relation within a combined slot defined by slots in sides of a pair of adjacent circuit breakers.

* * * * *